US005139061A

United States Patent [19]

Neilson

[11] Patent Number: 5,139,061

[45] Date of Patent: Aug. 18, 1992

[54] ROUTER BASE TABLE INSERT

[76] Inventor: Patrick J. Neilson, Box 516, R.D. 2, Portage, Pa. 15946

[21] Appl. No.: 783,340

[22] Filed: Oct. 28, 1991

[51] Int. Cl.[5] ..... B27C 5/00

[52] U.S. Cl. ..... 144/134 A; 144/134 R; 144/136 R; 144/1 E; 144/286 R; 409/182

[58] Field of Search ..... 409/182, 97, 110; 144/134 R, 134 A, 134 D, 136 R, 136 C, 1 E, 286 R, 286 A

[56] References Cited

U.S. PATENT DOCUMENTS 2,799,305 7/1957 Groehn ..... 144/134 A
3,710,833 1/1973 Hammer et al. ..... 144/134 A
3,901,275 8/1975 Downing ..... 144/134 A
4,537,234 8/1985 Onsrud ..... 144/134 A
4,679,606 7/1987 Bassett ..... 144/134 A

*Primary Examiner*—W. Donald Bray
*Attorney, Agent, or Firm*—H. Jay Spiegel

[57] ABSTRACT

A device is disclosed which is designed to be mounted on a plunge router in such a manner that the turning of a crank may be used to adjust the elevation of the router with respect to the associated table. The device includes support columns designed to slidably mount through openings in the router handles and a crank mechanism within one of the support columns and which may be rotated to adjust the elevation of the router. In addition, a transparent insert may surround the router drive shaft beneath the router bit.

7 Claims, 3 Drawing Sheets

ROUTER BASE TABLE INSERT

BACKGROUND OF THE INVENTION

The present invention relates to a router base table insert. In the prior art, devices designed to be used to support a rotary tool in an adjustable manner are known. U.S. Pat. Nos. 2,799,305 to Groehn, 2,888,965 to Phillips, 3,581,787 to Bane and 4,484,608 to Ferdinand et al. are known to Applicant. However, none of these patents includes all of the various aspects and features of the present invention, especially concerning the vertical adjustability of an inverted router as well as the particular manner of support of the inverted router under a table, which features are included in the present invention.

SUMMARY OF THE INVENTION

The present invention relates to a router base table insert. The present invention includes the following interrelated objects, aspects and features:

(a) In a first aspect, the present invention is intended to be used along with an existing router table and an existing router having passageways therethrough designed to support support columns.

(b) The present invention contemplates the use of a threaded rod which may be reciprocated with respect to a support column to cause reciprocation of the router as inverted underneath the router table to desired vertical positions.

(c) In a further aspect, a transparent cover is provided for an opening in the table through which the drive shaft of the router may protrude, with this cover being interchangeable with covers having differing opening sizes to allow accommodation for router bits of varying dimensions.

As such, it is a first object of the present invention to provide a router base table insert.

It is a further object of the present invention to provide such a device which allows easy vertical adjustability of the elevation of a router which is inverted under a router table from above.

It is a still further object of the present invention to provide such a device wherein a crank mechanism may be rotated to provide the vertical adjustability thereof.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
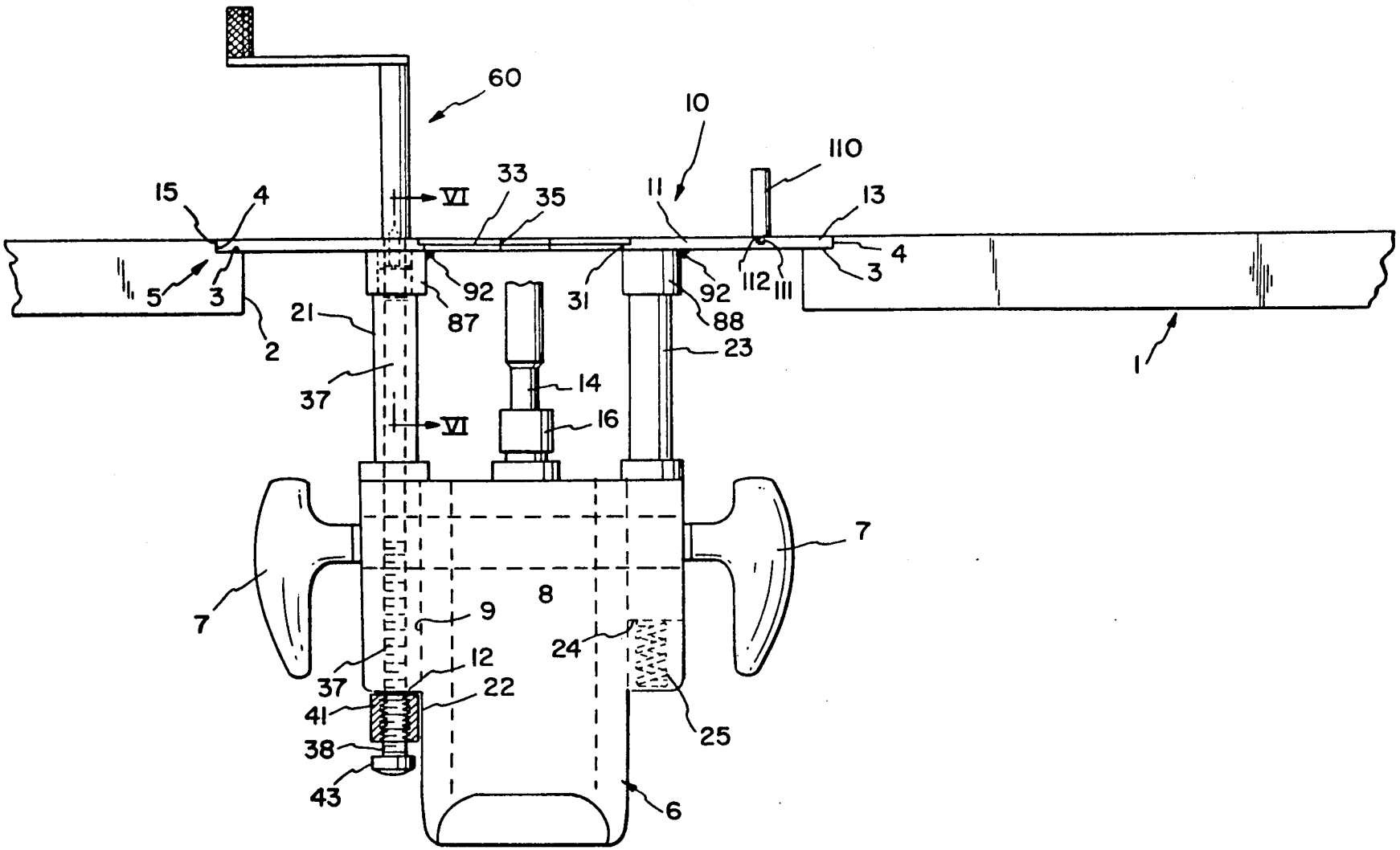
FIG. 1 shows a side view of the present invention with portions broken away and/or shown in cross-section to show detail.

With reference to FIG. 1, a router table 1 is seen to have an opening 2 having an upper extent defined by a peripheral shoulder 5 having perpendicular walls 3 and 4. In FIG. 1, the present invention is generally designated by the reference numeral 10 and is seen to include a flat plate 11 having a periphery 13 sized and configured to sit on the wall 3 with the outer edges of the plate 11, which are designated by the reference numeral 15 engaging or being closely spaced from the wall 4.

As also shown in FIG. 1, a router 6 has handles 7 as well as a blind passageway 8 and a passageway 9 having an opening 12 at the bottom thereof.

The router 6 has a bit 14 removably attached to a chuck 16 forming a part of the router 6. The chuck 16 is adjustable to allow attachment of bits of varying diameters and other dimensions. Chuck 16 is of collet design, ½ inch being standard. Smaller collets can be used inside of a ¼ inch collet.

With further reference to FIG. 1, it is seen that support columns 21 and 23 are provided and are sized and configured to reciprocate within the respective passageways 9, 8. As shown in phantom in FIG. 1, the passageway 8 has a spring 25 at the bottom thereof which engages the bottom 24 of the support column 23 to tend to move the support column 23 in the upward direction in the view of FIG. 1 with respect to the router 6 and passageway 8. A similar spring is also included within the passageway 7 and is sized and configured to be retained within the passageway 9 despite the existence of the opening 12.

As further shown in FIG. 1, the plate 11 includes an opening 31 which may removably receive an insert 33 having a central opening 35 sized and configured to allow structure of the bit 14 to extend therethrough without engaging or otherwise touching the opening 35. The insert 33 is preferably made of a transparent material such as that which is marketed under the trademark LEXAN to allow visibility of the inner workings of the device 10 and the router 6 beneath the table 1.

Figure 5:
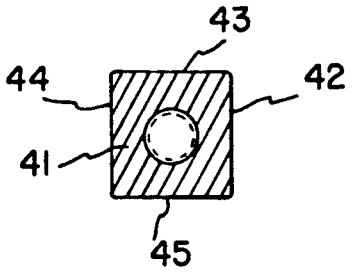
FIG. 5 shows a cross-sectional view through the thread block of the present invention.

With further reference to FIG. 1, a threaded adjustment rod 37 is provided which extends through the support column 21, through the passageway 9 and through the opening 12 of the router 6 where it is threaded through a threaded block 41 and capped with a detachable stop knob 43. The stop knob 43 has a blind threaded bore into which the end of the threaded rod 37 may be threaded until the stop knob 43 is tightened thereon. With particular reference to FIG. 5, it is seen that the threaded block 41 has a generally square cross-section defined by the walls 42, 43, 44 and 45 with one of these walls bearing against the flat wall surface 22 of the router 6 to prevent rotation of the threaded block 41 when the threaded rod 37 is rotated with respect thereto. The stop knob 43 is provided to limit the degree of movement of the router 6 with respect to the plate 11. When the stop knob 43 engages the threaded block 41, further movement is precluded.

Figure 2:
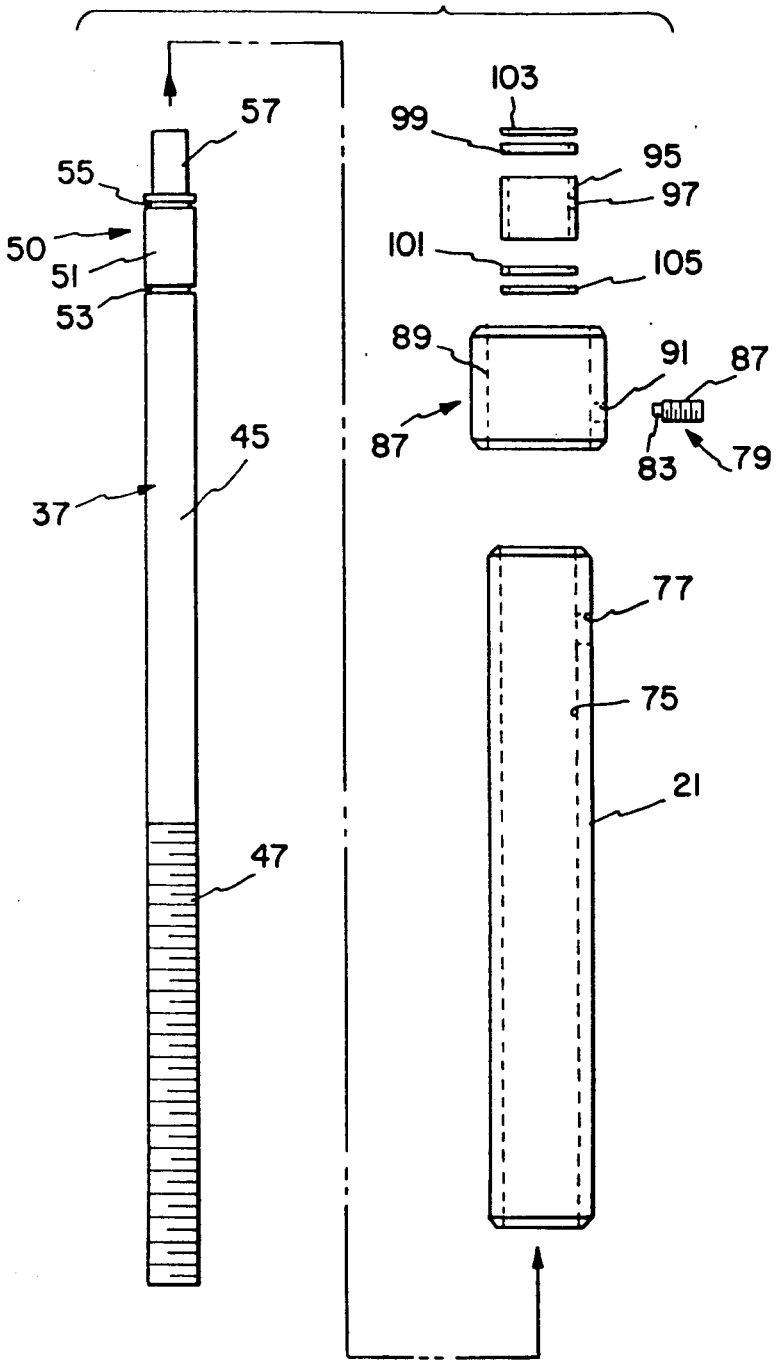
FIG. 2 shows a side exploded view of one support column of the present invention.
Figure 3:
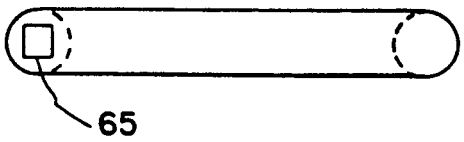
FIG. 3 shows a top view of the crank mechanism of the present invention.
Figure 4:
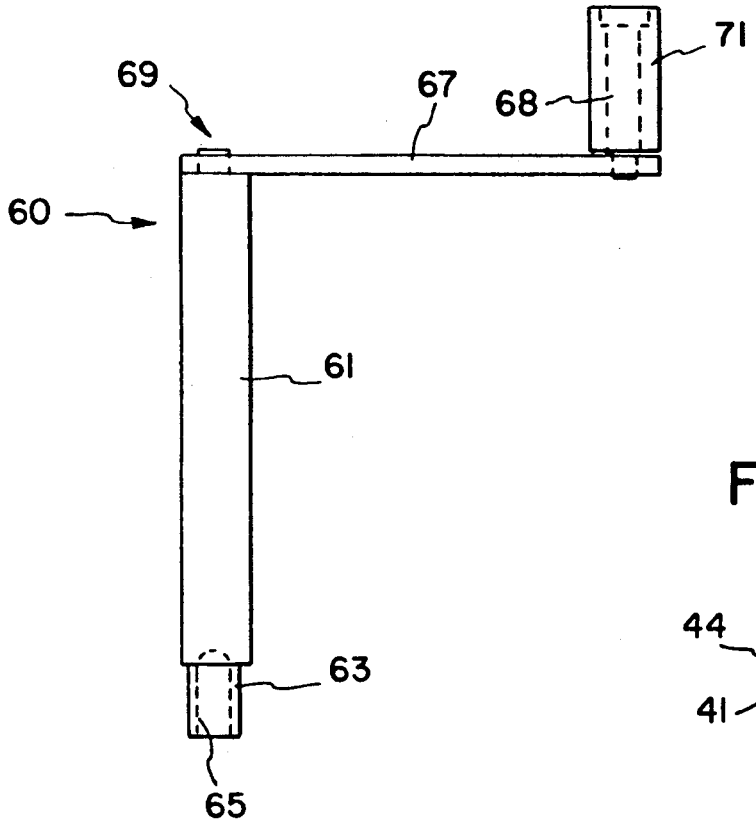
FIG. 4 shows a side view of the crank mechanism of the present invention with portions in phantom to show detail.
Figure 6:
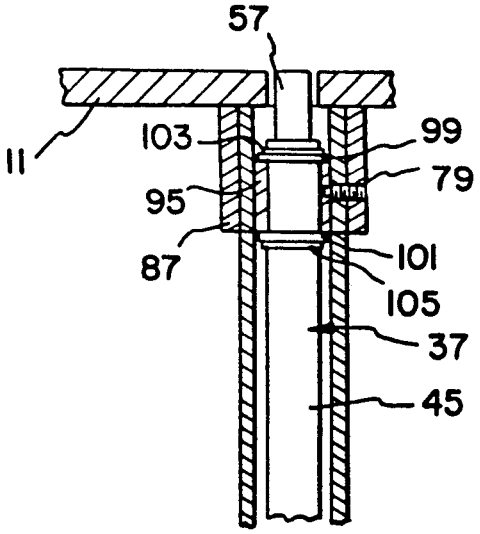
FIG. 6 shows a cross-sectional view along the line VI—VI of FIG. 1.

With particular reference to FIGS. 2 and 6, the assembly and operation of the threaded rod 37 will now be described in great detail. As shown in FIG. 2, the threaded rod 37 has a region 45 with a smooth outer periphery, a region 47 which is threaded and a region above the region 37 and generally designated by the reference numeral 50. The region 50 has a smooth section 51 with annular grooves 53, 55 surrounding the region 51. Above the groove 55, a square cross-section coupling 57. With reference to FIGS. 3 and 4, it is seen that the actuator handle 60 has a shaft 61 having a reduced diameter portion 63 with a square cross-section recess 65 therein sized and configured to couple with the coupling 57 of the threaded rod 37. With further reference to FIGS. 3 and 4, it is seen that the shaft 61 has a perpendicular arm 67 fixedly coupled thereto at a coupling 69, as well as a knob 71 rotatably mounted with respect to the arm 67 by a rotary bearing 68.

With reference back to FIG. 2, the support column 21 has an internal passageway 75 as well as a threaded opening 77 sized to threadably receive a dog point set screw 79 having a threaded portion 81 as well as a dog point 83. The sleeve 87 has an inner bore 89 which is sized to allow the sleeve 87 to slide over the outer periphery of the support column 21, with the threaded opening 91 through the sleeve 87 being alignable with the threaded opening 77 of the support column 21 whereupon the dog point set screw 79 may be threaded through the aligned openings 77, 91 to assemble the sleeve 87 to the support column 21.

In a further aspect, a bushing 95 is seen to include a blind recess 97. With the sleeve 87 mounted on the column 21, the bushing 95 may be inserted within the column 21 with the recess 97 aligned with the threaded openings 77, 91 so that the dog point 83 of the set screw 79 may enter the recess 97 to fixedly locate the bushing 95 in a desired location within the passageway 75 of the support column 21.

Surrounding the bushing 95 are bearing washers 99, 101 as well as snap rings 103 and 105. As should be understood from FIGS. 2 and 6, the snap ring 103 enters the groove 55 of the threaded rod 37 while the snap ring 105 enters the groove 53 of the threaded rod 37 to vertically fix the position of the threaded rod 37 with respect to the support column 21 and the sleeve 87 so that the threaded rod 37 may rotate within the support column 21 and the bushing 95 without relative reciprocatory movements. Thus, the threaded rod 37 will accordingly reciprocate with respect to the threaded block 41 to cause reciprocatory movements of the router 6 with respect to the plate 11 and table 1.

In the operation of the present invention, the router 6 is assembled to the plate 11 in the manner shown with the sleeves 87, 88 welded to the underside of the plate 11 with welds 92. The support column is inserted within the passageway 8 of the router 6 with the end 24 thereof bearing against the spring 25. The column 21 assembled as shown in FIGS. 2 and 6 is inserted within the passageway 9 and bears against a spring (not shown) similar to the spring 25.

With the threaded rod 37 inserted as shown in FIG. 1 with its end 38 protruding through the opening 12, and threaded through the threaded block 41 with the stop knob 43 mounted thereon, a router bit 14 is chosen and fitted into the chuck 16. An insert 33 made of a transparent material and having an opening 35 sized and configured to freely allow passage therethrough of the bit 14 is installed in the opening 31.

With this configuration having been achieved, the handle 60 is coupled with the square recess 65 fitting over the square protrusion 57 of the threaded rod 37. With this configuration of elements having been so assembled, rotary movements of the handle 60 will result in rotations of the threaded rod 37 with the threaded block 41 causing rotations of the threaded rod 37 to result in reciprocatory movements of the router 6 with respect to the plate 11. The springs such as the spring 25 will tend to bias the router 6 downwardly in the view of FIG. 1 as the router 6 moves upwardly in the view of FIG. 1 with respect to the support columns 21, 23. The spring force will tend to ease downward movements of the router 6 with respect to the plate 11 while maintaining the bit 14 in a stable configuration with respect to the work which is being performed.

In a further aspect, a guide pin 110 may be threadably received within a threaded bore 111 of the plate 13, with the guide pin 110 having a threaded portion 112 for this purpose. The guide pin is provided for reasons known to those skilled in the art to guide work with respect to the location of the bit 14.

As such, an invention has been disclosed in terms of a preferred embodiment which fulfills each and every one of the objects of the invention as set forth hereinabove and provides a new and useful router base table insert of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. In a table having an opening, the improvement comprising a machine support comprising:
   a) a plate sized to fit over said opening;
   b) a support column having a passageway therethrough, said column being fixed under said plate and a machine mounted on said column for relative reciprocatory movements of said machine with respect to said column;
   c) a threaded rod in said passageway, said rod being rotatable with respect to said column but constrained against reciprocation with respect thereto;
   d) a threaded block threaded on said rod and constrained against (1) rotation with respect to said column and (2) reciprocation with respect to said machine;
   e) whereby rotation of said rod results in reciprocation of said machine with respect to said table.

2. The invention of claim 1, wherein said opening has a recessed periphery, said plate sized to sit on said periphery.

3. The invention of claim 1, further including a further support column fixed under said plate and mounted on said machine for relative reciprocatory movements with respect thereto.

4. The invention of claim 1, wherein said machine comprises a router having a bit.

5. The invention of claim 4, wherein said plate has a plate opening covered by a removable cover, said cover having a hole sized to allow said bit to extend therethrough.

6. The invention of claim 1, further including a handle above said plate coupled to said threaded rod.

7. The invention of claim 5, wherein said plate cover is made of plastic.

* * * * *